US005607235A

United States Patent [19]

Campbell

[11] Patent Number: 5,607,235

[45] Date of Patent: Mar. 4, 1997

[54] HIGH SPEED COMBINED MIXING AND TRANSPORT TOOL

[76] Inventor: Craig C. Campbell, P.O. Box 12698 Research Triangle Park, Durham, N.C. 27709

[21] Appl. No.: 398,421

[22] Filed: Mar. 3, 1995

Related U.S. Application Data

[63] Continuation of Ser. No. 936,628, Aug. 24, 1992, abandoned, which is a continuation of Ser. No. 552,066, Jul. 13, 1990, abandoned.

[51] Int. Cl.[6] ..... B01F 7/04; B01F 15/06

[52] U.S. Cl. ..... 366/325.2; 366/147; 366/325.3; 366/326.1

[58] Field of Search ..... 366/1, 2, 13, 64–67, 366/97, 102, 103, 104, 144, 147, 168, 177, 194–196, 285, 292, 325–328, 331, 603

[56] References Cited

U.S. PATENT DOCUMENTS

| | | | |
|---|---|---|---|
| 35,110 | 4/1862 | Pierce | 366/325 X |
| 74,467 | 2/1868 | Williams | 366/285 |
| 74,941 | 2/1868 | Raynor | 366/328 X |
| 737,583 | 9/1903 | Coffey | 366/325 X |
| 1,036,683 | 8/1912 | Mueller | 366/64 |
| 1,207,512 | 12/1916 | Dickson | 366/326 X |
| 1,355,137 | 10/1920 | Frick | 366/326 |
| 1,540,547 | 6/1925 | Doidge | 366/46 |
| 2,600,408 | 6/1952 | Komarek | 416/122 X |
| 3,020,025 | 2/1962 | O'Mara | 366/326 X |
| 3,090,606 | 5/1963 | Burnet | 366/326 |
| 3,343,814 | 9/1967 | Mund | 366/103 |
| 3,397,869 | 8/1968 | Webster | 366/327 |
| 3,471,131 | 10/1969 | Fritzweiler et al. | 366/305 |
| 3,601,371 | 8/1971 | Ross | 366/325 |
| 3,622,126 | 11/1971 | Eberle | 366/177 X |
| 3,650,319 | 3/1972 | Boon | 366/147 X |
| 3,661,363 | 5/1972 | Aletti | 366/322 X |
| 3,770,251 | 11/1973 | Herfeld | 366/292 X |
| 3,845,940 | 11/1974 | Lodige et al. | 366/285 X |
| 4,053,144 | 10/1977 | Ellwood | 366/97 |
| 4,281,934 | 8/1981 | Krause et al. | 366/326 X |
| 4,366,123 | 12/1982 | Kato et al. | 366/277 X |
| 4,370,945 | 2/1983 | Beckschulte et al. | 366/147 X |
| 4,669,966 | 6/1987 | Deuren | 425/209 |
| 4,826,323 | 5/1989 | Loomans et al. | 366/85 |
| 4,871,260 | 10/1989 | Tadmor et al. | 366/99 |
| 4,887,907 | 12/1989 | Hahn et al. | 366/147 X |
| 5,033,861 | 7/1991 | Hahn et al. | 366/147 X |

FOREIGN PATENT DOCUMENTS

| | | | |
|---|---|---|---|
| 556495 | 7/1923 | France | 366/300 |
| 58461 | 9/1891 | Germany | 366/13 |
| 74618 | 9/1893 | Germany | 366/330 |
| 2702795 | 7/1978 | Germany | 366/326 |
| 2735388 | 7/1978 | Germany | 366/343 |
| 2736812 | 3/1979 | Germany | 366/147 |

*Primary Examiner*—Charles E. Cooley
*Attorney, Agent, or Firm*—Wallace J. Nelson

[57] ABSTRACT

A blender mixing shaft and a high speed transport and mixing tool combination wherein the blender mixing shaft has a sidewall and a hollow interior and at least one transverse opening provided through the sidewall with an elongated, hollow, transport and mixing tool attached to a flat surface segment thereof and, in sealed fluid communication with the hollow mixing shaft. The mixing tool is provided with an exterior surface including a mixing shaft attachment end and a triangular plow shaped terminating end with the area therebetween comprising a substantially uniform triangular cross-section along its length. The triangular shaped length has a base side with two sides extending from the base side to form an apex for the triangular shaped length. Attachment structure, either a U-shaped casting or a threaded section, is provided integral with the attachment end of the mixing tool to provide the fluid tight seal between the shaft and tool and to provide essentially perpendicular alignment of the tool center axis with the axial center of the mixing shaft. The attachment structure further provides for a pitch angle selection of the triangular tool base relative to a plane taken parallel with the center axis of the mixing shaft.

10 Claims, 9 Drawing Sheets

HIGH SPEED COMBINED MIXING AND TRANSPORT TOOL

This application is a CONTINUATION of application Ser. No. 07/936,628, filed Aug. 24, 1992, now abandoned, for "A HIGH SPEED COMBINED MIXING AND TRANSPORT TOOL (AMENDED)", which is a CONTINUATION of abandoned application Ser. No. 07/552,066, filed Jul. 13, 1990 for "A NEW BATCH BLENDER OR NEW CONTINUOUS BLENDER DESIGN BASED ON A NEW INVENTION A MIXING TOOL".

BACKGROUND OF THE INVENTION

The present invention pertains to a blender utilizing a new tool design which is applicable to a wide variety of matrices. The triangular shape of the tool can be varied to provide a wide degree of variation in retention time in various zones of the blender along with the quality of mixing and output for controlled period testing or for permanent set up for production. The novel shape of the tool together with the change of orientation of the tool to the right or to the left imparts variation within the blender by allowing for a change to control the degree of output (transport) forward or backward as well as providing for zones of control within the blender. Rotation of the tool thereby allows forward movement, holding or a reverse flow of the materials inside the blender. Thus the degree of filling within selected zones are possible and a wide degree of variation and control is provided.

DESCRIPTION OF THE PRIOR ART

Apparatus, continuous blenders, are well known for applying liquid resin to wood particles or other matrices. Diverse systems using air atomized spray injection are used. Airless spray systems are also used. These systems require a battery of nozzles and high pressure air lines in addition to an air pressure source. The most popular current systems are: (1) hollow shaft fed systems, and (2) side tube injector systems.

Current continuous blenders for particle board consist of a single chamber of cylindrical design approximately 24 inches in diameter and 12 feet long. Current blenders also use a single high speed shaft (700 to 1000 RPM). a rotary joint is used to feed cooling water to the shaft. An internal water system network system is used to feed cooling water to the mixing tool extremities.

A continuous mixer, even though it consists of a single physical chamber, is generally understood by those versed in the art to contain three distinct and separate functioning zones:

A. the front third—the loading zone—tools in this area are called paddles or shovels (to begin solids moving) and are not water cooled.

B. The middle third—a resin in-put zone—tools are called resin arms (extending from a central shaft) or resin tubes (when injecting resin from the side of the vessel)—these tools are not water cooled.

C. The last third—the mixing zone—water cooled mixing tools act like stirring fingers as in a kitchen mixing bowl. In order to provide a long life for the tool (especially the tip area) typically a heavy, usually rough wear coating (silicon carbide) is placed on the tool wear areas.

Two major factors have been prominent in the particle board industry in recent years:

A. Larger production plants—therefore requiring larger blenders.

B. Specialization of fiber types and separation:

1. Face—100 percent fines (below 40 mesh)—dictated by decorative printing requirements. (15 pounds per cubic foot)
2. Core—more fluffy, fibrous, fuzzy character material from attrition mills—giving greater core strength after bonding-fiber fiber has much more bulk—i.e. lower bulk density of 6 pounds per cubic foot.

Now it becomes apparent that instead of one line of production, many plants must have two lines of production, one line for face (using fines) and one line for core (using fluffy material); and furthermore the blenders in the respective lines must perform different functions.

The changes in recent years have resulted in major disadvantages:

1. Use of 100 per cent fines (below 40 mesh) results in the need for more resin (the most expensive single ingredient). It is commonly known that "fines rob the resin" and "fines destroy resin efficiency"—terms often heard.
2. Fluffy character and lower bulk density results in a fluidity, a liquidity, a mass flow inside the blender.
3. There is total mass movement inside the blender.
4. The larger and longer machines with longer distances between bearings must be limited to lower RPM speed.
5. There is less stirring and less random particle-to-particle contact.
6. Larger machines result in greater imbalance, and greater vibration on high platforms.
7. Limited work energy is applied to mixing.
8. Higher resin costs.
9. Marginal and lower board quality.

SUMMARY OF THE INVENTION

The preferred embodiment of this invention is a blender invention based upon a newly invented linear tool that is triangular in cross section.

This invention also relates to a method of using plow action, a wedge, in small increments in such a manner as to transport and at the same time to disrupt mass flow.

The invention provides a total mixing action from bearing to bearing, without the requirement of a loading zone and resin in-put zone—both of which take up two-thirds of the blender cavity.

Reducing the space between bearings or the length of the blender permits higher RPM speeds of shaft rotation. Higher work energy can be put into the product mixing. Furthermore with similarly shaped and sized tools on the shaft, there is a more balanced and stable condition while operating. One tool design simultaneously transports, controls temperature (cooling or heating) and blends.

The new triangular shaped tool has a hollow interior for temperature control and a means for attachment of the tool to the hollow shaft of the blender to provide a fluid tight connection. The triangular shaped tool means for attachment also mounts the triangular shaped tool essentially perpendicular to the blender shaft so that the center axis of the triangular shaped tool is essentially perpendicular to the center axis of the shaft, as is conventional.

BRIEF DESCRIPTION OF THE DRAWINGS

FIGS. 1*a–d* illustrate a top plan view of various representative triangular tool shapes, wherein FIG. 1*a* is representative of a tool with an isosceles cross sectional configuration; FIG. 1*b* is a tool with a scalene triangular configuration; FIG. 1*c* is a tool with an acute triangular cross sectional configuration, and FIGS. 1*b* and 1*d* are examples of tools with a right triangular cross sectional configuration.

FIGS. 1*a–d* also schematically show the direction of movement for the various tool shapes when mounted on a rotating blender shaft, along with the direction of the vector forces produced thereby, when the tools are mounted with the triangle bases thereof disposed on a plane parallel with the axis of rotation of the blender shaft.

FIGS. 2*a–d* also show the apex of the triangular shaped tools formed by the intersection of two substantially flat sides extending from the triangle base.

DESCRIPTION OF THE PREFERRED EMBODIMENTS

Referring now to FIG. 1*a–d* various forms of triangular shapes representing isosceles, scalene, obtuse, right triangular and acute triangular designs having smooth sides are illustrated. Each shape could represent the shape of a linear tool of a selected dimension, fabricated, welded, cast metal, or other material.

FIGS. 1*a–d* also illustrates that assuming the tool 10 is (each tool) mounted (i.e. on a rotating shaft) and moved (rotated) in direction 12 there will be a resulting vector force 14. The direction and magnitude of the resulting vector force in each case might be developed by a combination of factors: (1) tool design in cross section; (2) tool position in its support mounting; (3) direction of movement; (4) RPM speed; (5) horsepower used.

Figure 1A:
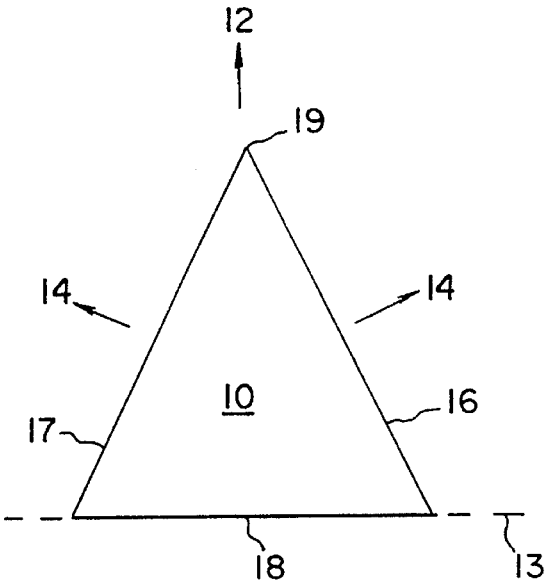
Figure 1B:
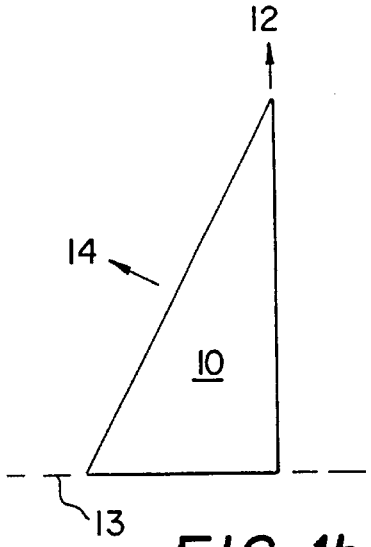
Figure 1C:
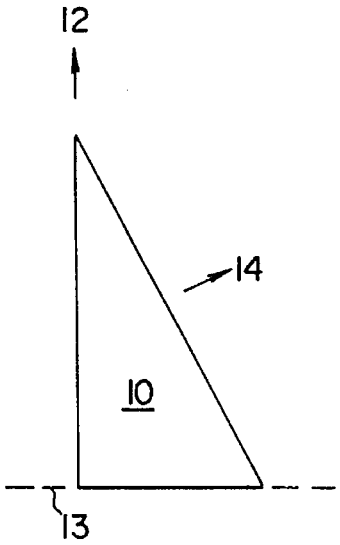
Figure 1D:
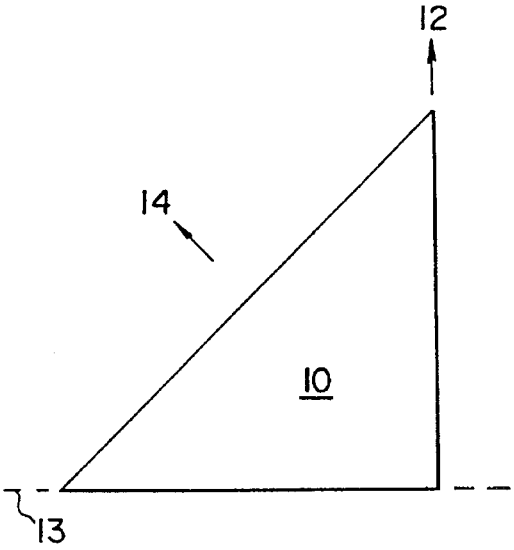
Figure 2A:
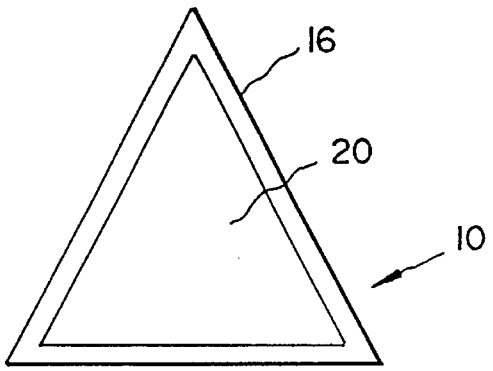
FIGS. 2*a–d* illustrate a cross section view of the various representative triangular tool shapes of FIGS. 1*a–d* showing the hollow tools and the tool walls.
Figure 2B:
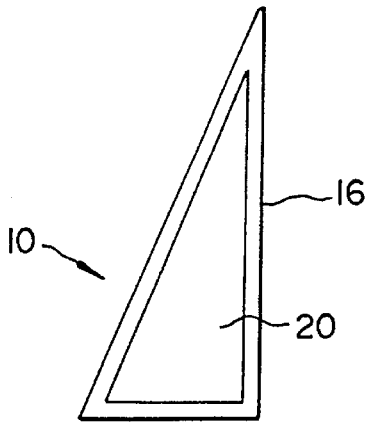
Figure 2C:
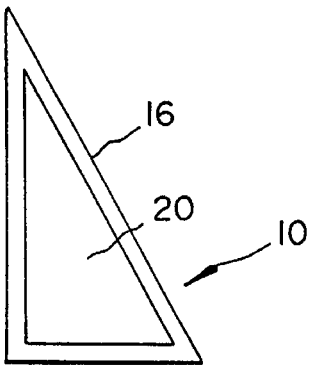
Figure 2D:
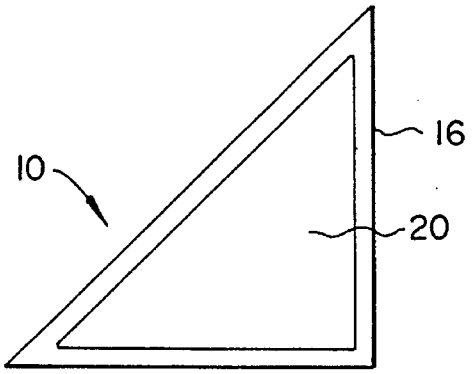

Referring more specifically to FIG. 1*a*, the isosceles shaped triangular tool 10 has a pair of smooth sides 16, 17 extending from base side 18 and terminating in an apex 19. Thus, when tool 10 is mounted on a rotating shaft and moving in the direction of arrow 12, a vector force 14 will be generated from both sides 16 and 17, when base 18 is disposed on a plane 13 that is parallel with the center axis of the rotating shaft. When the orientation of tool 10 is such that base 18 is no longer on a plane parallel with the axis of the rotating shaft, the vector force 14 will be generated only from one of the triangle sides 16,17, as will be further explained hereinbelow.

Referring now to FIG. 2*a–d* shows in diagram the cross sections of several machine tools of triangular design. These tools would be quite strong when made of reliable materials—strength and stiffness is improved by the triangular shape. Tool walls 16 are illustrated. Also shown is the area for movement and flow for a temperature control medium in hollow center 20 of each of the tools 10. The medium may be cooling water, glycol, hot oil or other mediums.

Figure 3:
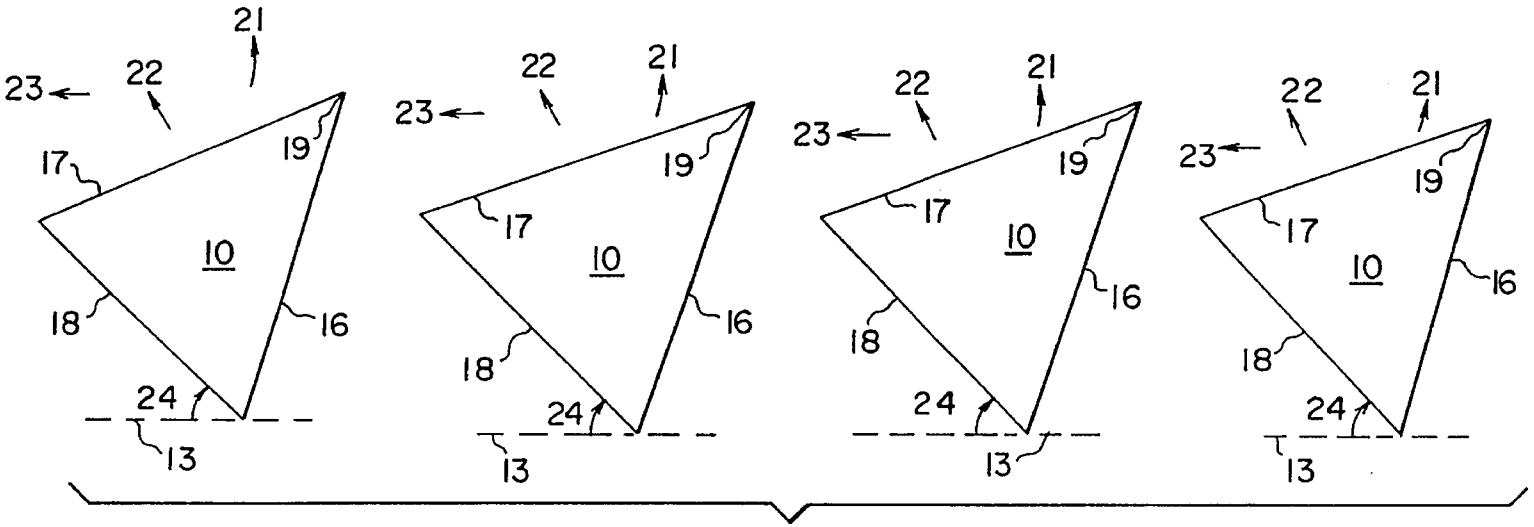
FIG. 3 illustrates a top plan diagrammatic view of four isosceles triangular cross section tools showing their plow shaped terminating ends as in FIG. 1*a*, and mounted on a shaft as viewed from a fixed point with the four triangular shaped tools having their base side orientated to the right in relation to the plane parallel to the rotating shaft center axis, as illustrated for the tool in FIG. 1*a*.

FIG. 3 diagrammatically illustrates the movement that can be accomplished in a matrix when a series of triangular tools are mounted together and oriented so as to operate in parallel, in this case four tools, and oriented to the right. Assuming the tools in FIG. 3 are mounted on a rotating shaft (rotation upward from this view) in direction 21, then the resulting vector force or movement created in the matrix by each individual tool is 22 as shown, and as the moving matrix encountered the wall (i.e. inside the cylindrical blender), then the collective movement would become direction 23 or right to left which for purposes of the present illustration is deemed to be in a FORWARD direction, if, in the blender the movement is RIGHT TO LEFT. The amount of movement FORWARD OR RIGHT TO LEFT —all other factors being equal—would be determined by the angle 24 that the base 18 of triangular tool makes with the plane 13 that is parallel to the axis of rotation of the rotating mixing shaft. Orientation of tool 10 at angle 24 also rotates apex 19 of tool 10 to the right to effectively negate any vector force generated by side 16 and limit the vector forces generated by tool 10 to the exposed or leading side 17 of the tool during mixing shaft rotation.

Therefore it can be concluded, that all other things remaining the same, it is possible to increase the rate of movement right to left by controlling the angle for setting the tools. Of course this method has its limits, but the point is that the movement can be controlled within zones or areas within the blender by the setting of the angle of the tools. For instance, a blender of marginal through-put can be improved in through-put by this method.

Figure 4:
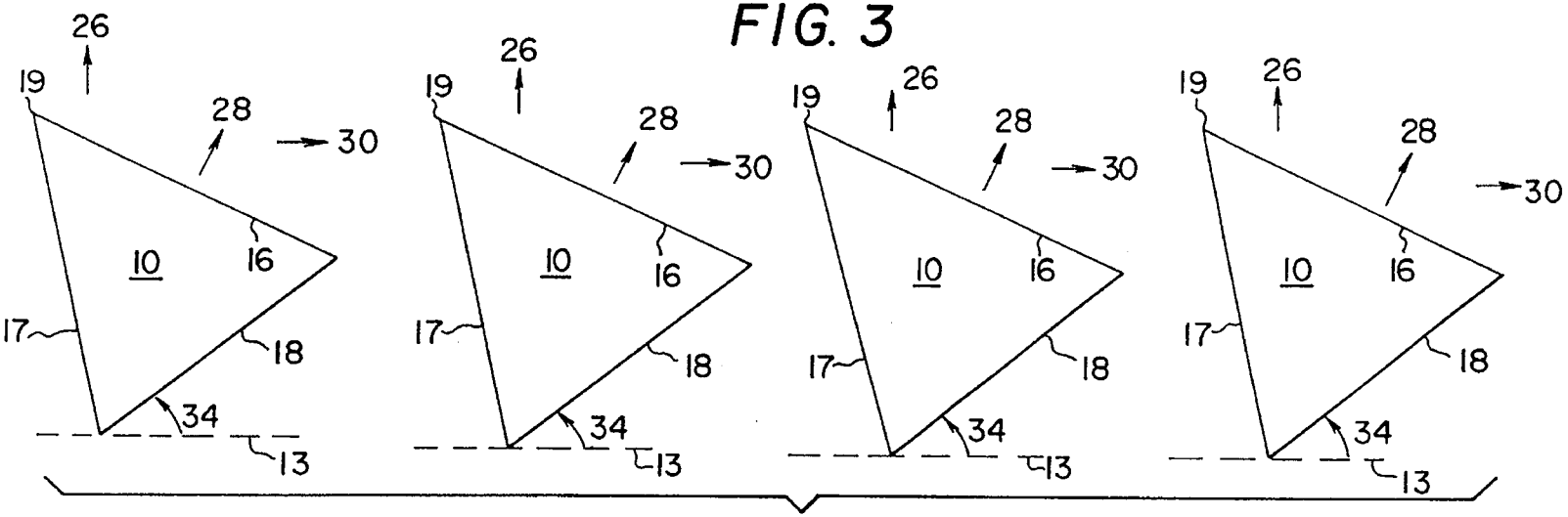
FIG. 4 illustrates a top plan diagrammatic view of four tools triangular in cross section mounted on a shaft as viewed from a fixed point with the four triangular shaped tools having their base side oriented approximately 40 degrees to the left in relation to the plane parallel to the rotating shaft center axis, as illustrated for the tool in FIG. 1*a*.

FIG. 4 illustrates the movement that is controlled inside a blender when base 18 of tools 10 as described in this embodiment are oriented approximately 40 degrees to the left relative to plane 13 that is parallel to the rotative axis of the rotating shaft. When rotation occurs (upwards from this view) then rotation is in the direction 26 and the resulting movement is 28 and the collective movement is 30 to the right or REVERSE WHEN BLENDER MOVEMENT IS RIGHT TO LEFT.

Orientation of tool 10 at angle 34 rotates apex 19 of tool 10 to the left and effectively negates any vector force generated by side 17 and limits the vector forces generated by tool 10 to the exposed or leading side 16 of the tool during mixing shaft rotation.

Here again, the degree of movement is basically controlled (within limits) by the "pitch" of the angle 34 of the setting of the tools, all other things remaining the same.

In the case of castings, the shape of the castings can determine the movement, without involving a resetting of the tool as in the case of a tool having a threaded attachment.

Figure 5:
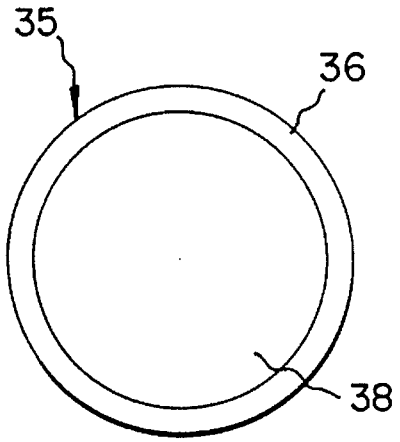
FIG. 5 illustrates a cross section view of a hollow blender shaft showing a section through the shaft.
Figure 6:
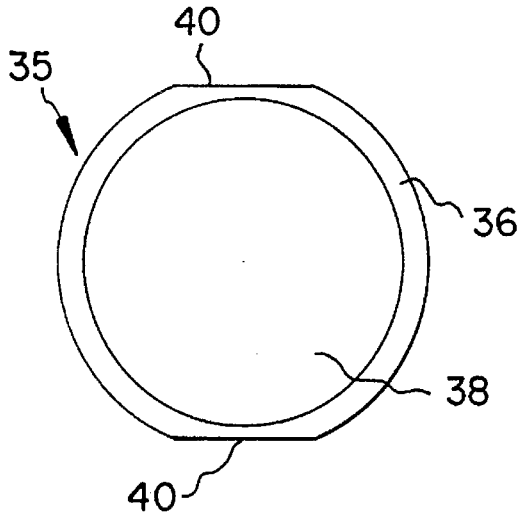
FIG. 6 illustrates a cross section view of a hollow blender shaft at a point axially displaced along the length of the blender shaft illustrating a flat machined area.

FIG. 5 and 6 illustrate the cross section of a hollow shaft showing the shaft wall 36 and the hollow shaft cavity 38. FIG. 6 illustrates that the machined areas (flat) 40 are located axially along the shaft opposite to one another to result in a balanced construction design.

Figure 7:
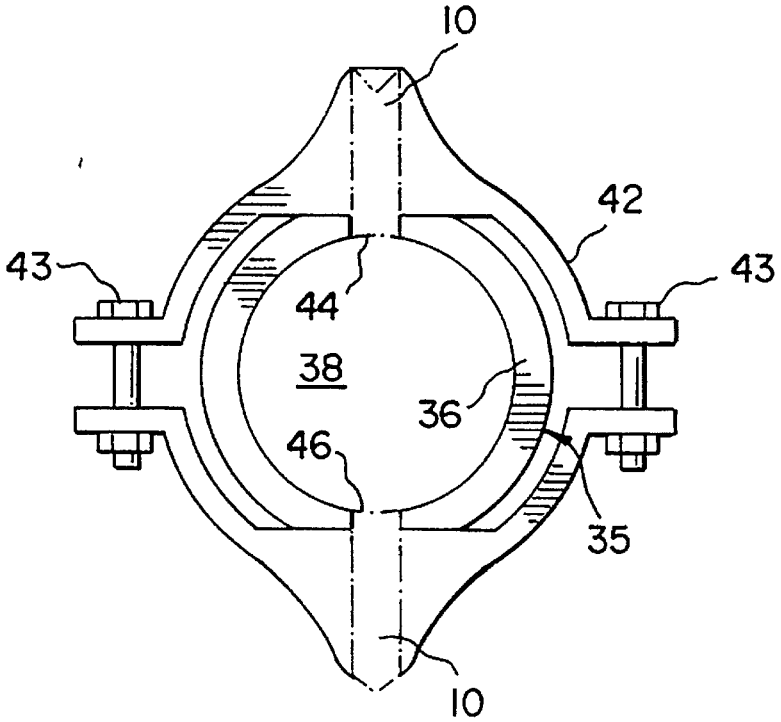
FIG. 7 illustrates the same cross section area of the shaft as in FIG. 6 with the lower portion of two tools mounted on the flat machined areas in which each tool includes its U-shaped mixing shaft attachment end that conventionally provides for the alignment of the center axis of the substantially triangular shaped tool essentially perpendicular to the center axis of the mixing shaft.

FIG. 7 illustrates the cross section of the hollow shaft similar to FIG. 6 showing the walls 36, the hollow shaft cavity 38 and the attached tools 10 (i.e. having a clamp 42 on or wrap around design) held in place by bolts 40. This design is a balanced construction (important at high RPM speeds, and useful for practical mounting on high platforms).

This design illustrated in FIG. 7 provides a rotatably balanced construction and includes a liquid medium seal (i.e. cooling water) at 44 and 46 and maintains the center of gravity central to the shaft and results in a balanced design.

Many of these factors improve the practicality of the design. These factors also make tools designed in accordance with the invention more readily available to a variety of industries, and useful for experiments.

Figure 8:
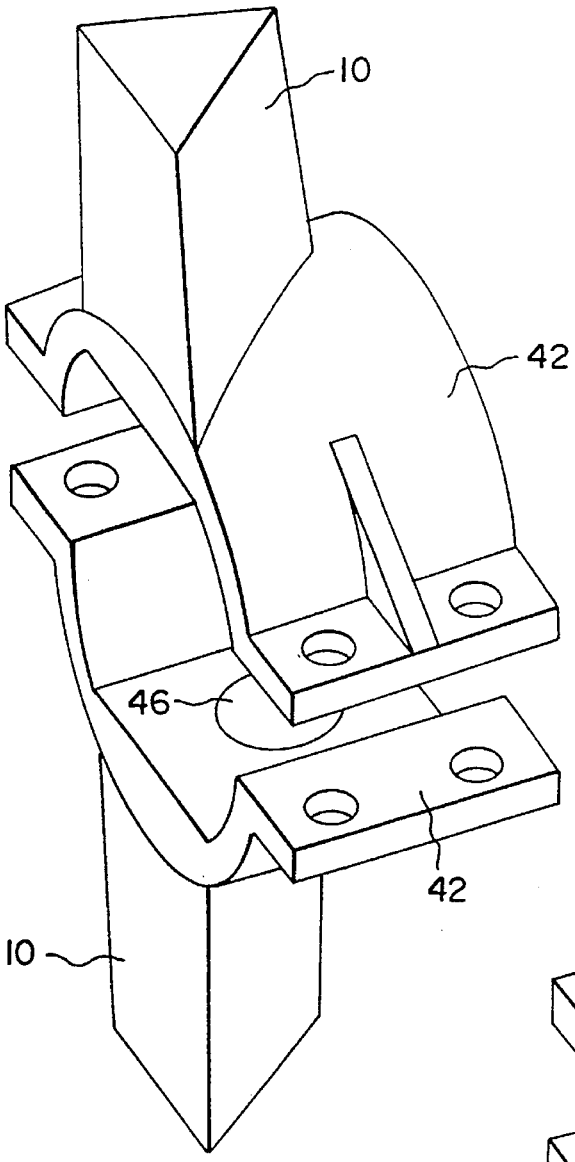
FIG. 8 is a perspective view of a pair of tools having a flange means for attachment to the blender shaft.
Figure 10:
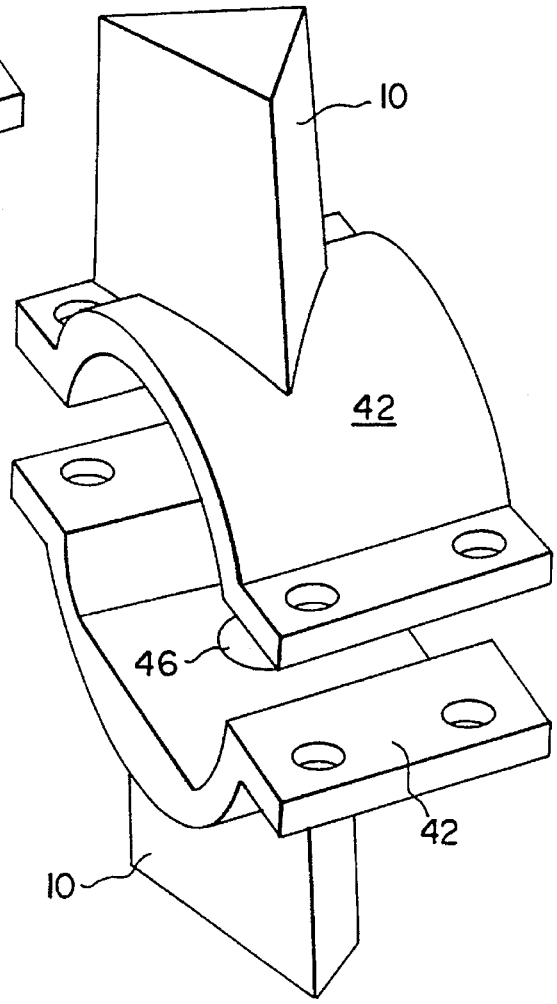
FIG. 10 is a perspective view of a pair of tools having a flange means and a modified angle of orientation.

Two tools 10 are illustrated in FIG. 8 each having a clamp 42 for attachment to the shaft walls 36 (FIG. 6). Each of the tools 10 include three sides to form a triangular tool as heretofore described and illustrated in FIGS. 1–3. The pitch of tools 10 are set by casting the tool to clamp 42 as illustrated in FIG. 8 and FIG. 10. The respective angle of orientation of the tool has previously been described with reference to FIGS. 3 and 4 with respect to angles 24 and 34.

Figure 9:
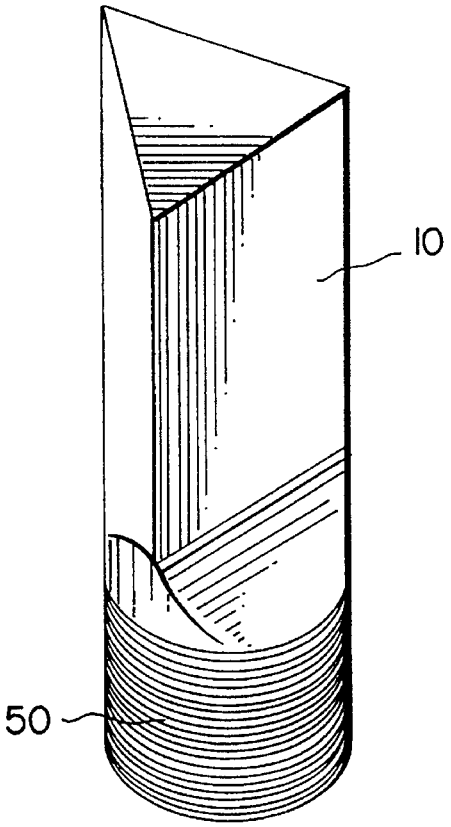
FIG. 9 is a perspective view of a tool having a threaded means for attachment to the blender shaft.

FIG. 9 illustrates a tool with a threaded means 50 for attachment to a blender shaft. The threaded means for attachment of the shaft allows the angle of orientation 24 and 34 in FIGS. 3 and 4 to the shaft to be set at the time the tool is screwed into the shaft.

Figure 11:
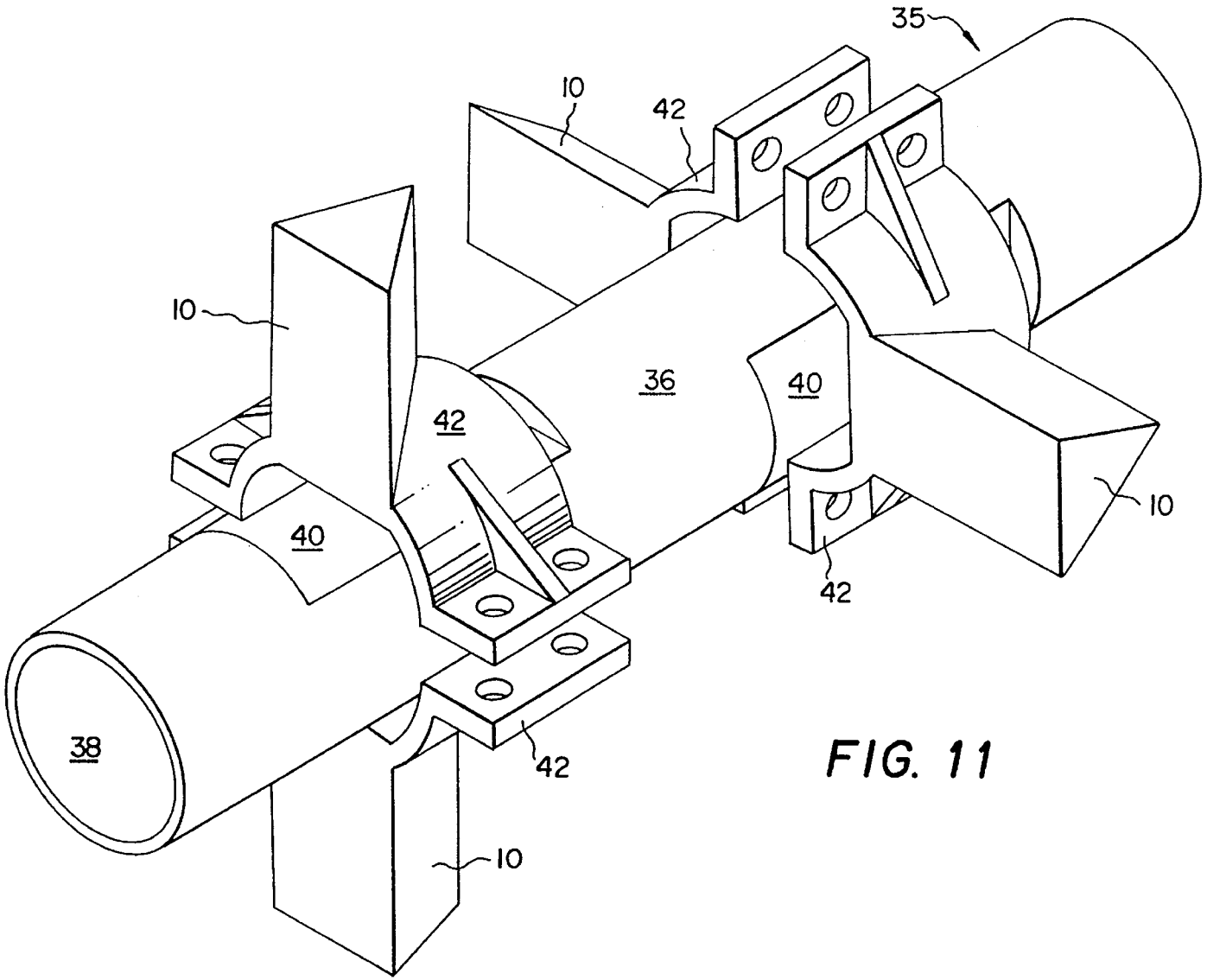
FIG. 11 is a perspective view of a blender shaft having a plurality of mixing tools mounted thereon.

Referring now to FIG. 11 a plurality of tools 10 each having a clamp 42 is illustrated attached to a blender shaft having a shaft wall 36 at various machined flat areas 40 to provide a balanced shaft and tool design as has heretofore been described.

Figure 12:
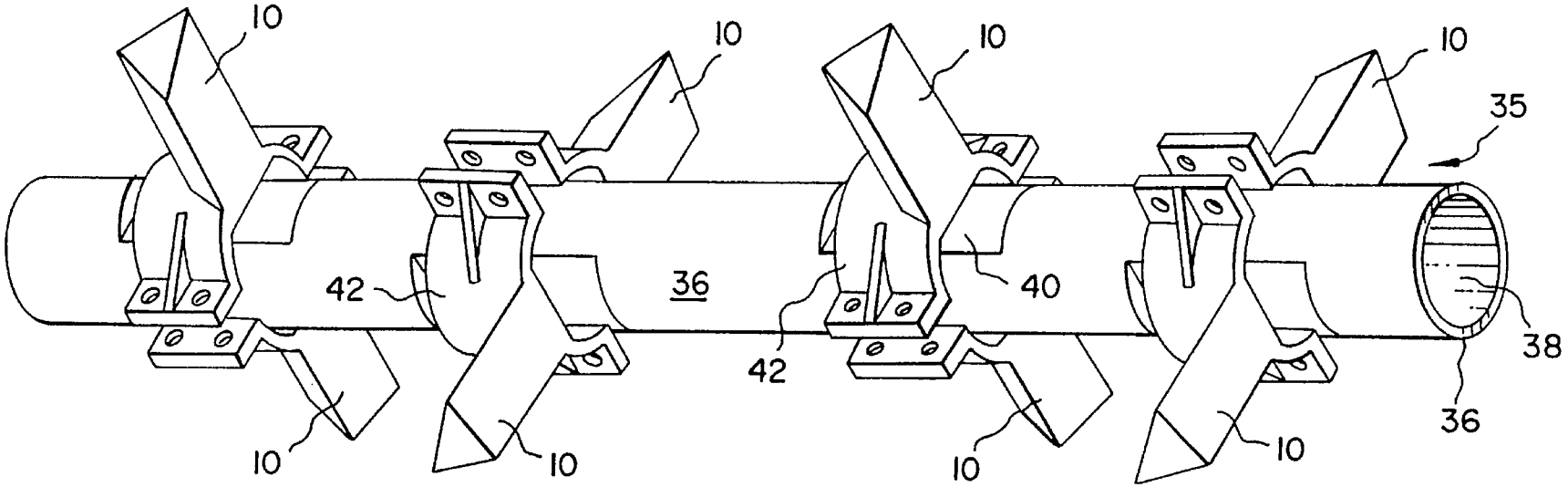
FIG. 12 is a perspective view of a blender mixing shaft with a plurality of mixing tools mounted thereon having angles of orientation in accordance with FIG. 3.
Figure 13:
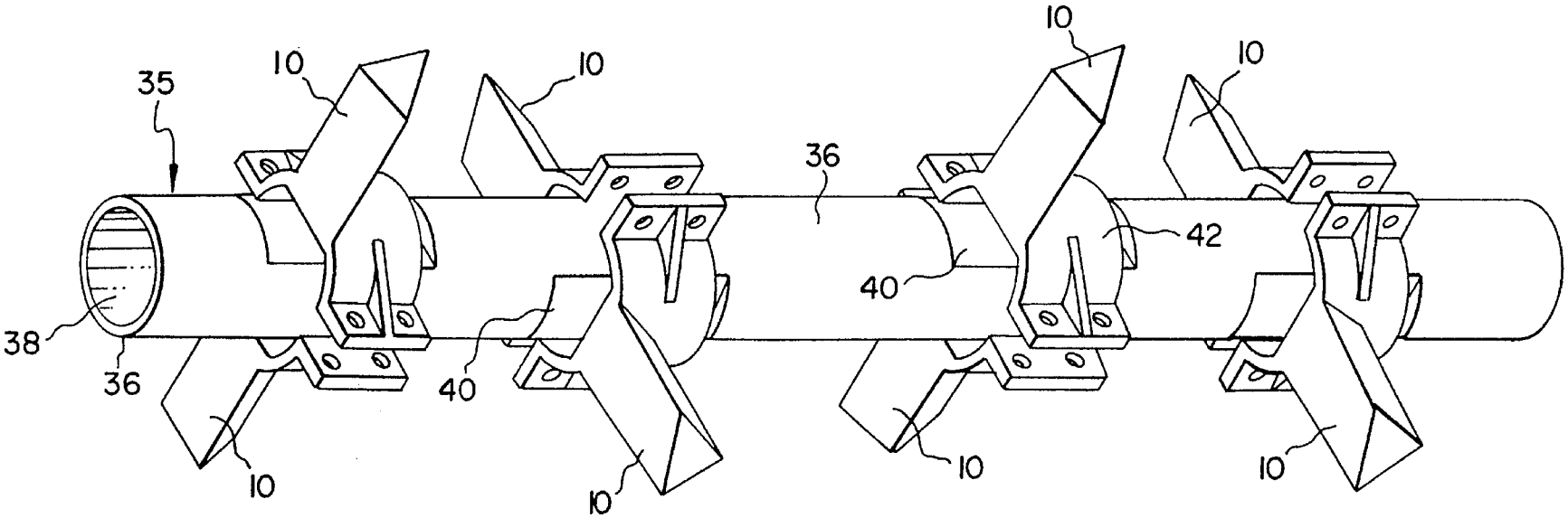
FIG. 13 is a perspective view of a blender mixing shaft with a plurality of mixing tools mounted thereon having angles of orientation in accordance with FIG. 4.

Referring now to FIG. 12 and 13 a blender shaft is illustrated with a plurality of tools 10 disposed on blender mixing shaft wall 36 as heretofore described in conjunction with FIGS. 1–7. In FIG. 12 the orientation of the tools corresponds to FIG. 3 and in FIG. 13 the orientation corresponds to FIG. 4.

Figure 15:
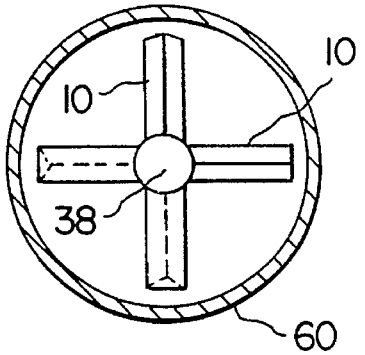
FIG. 15 is a side elevational view taken along the line 15—15 of FIG. 14.
Figure 14:
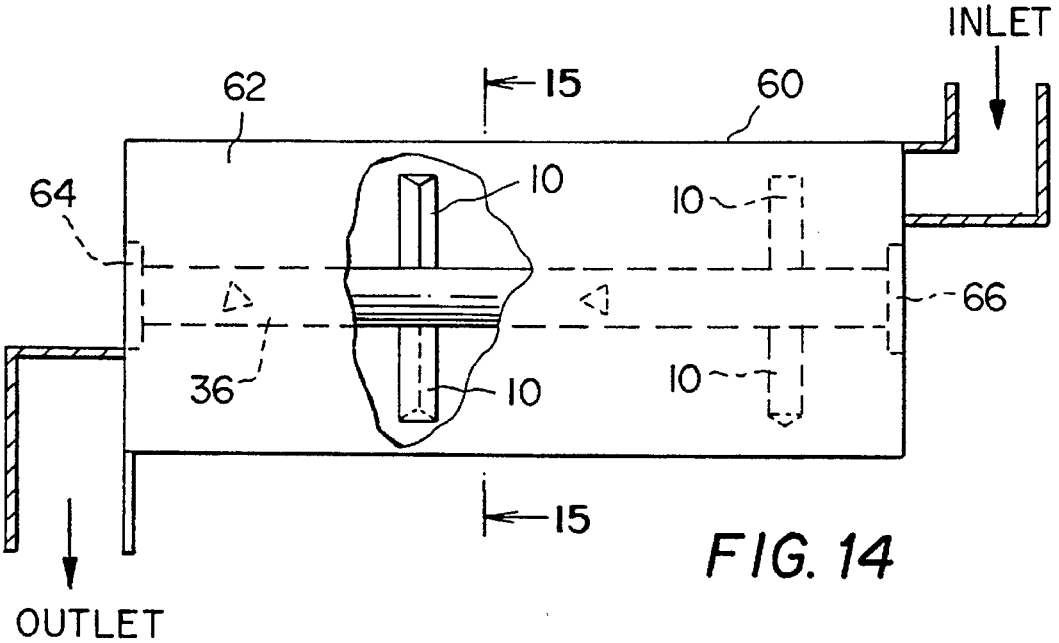
FIG. 14 is a side elevational view partly cut away illustrating a blender housing, blender mixing shaft and mixing tool.

FIG. 14 and 15 illustrate a blender 60 having a housing 62 with a blender mixing shaft having a wall 36 having a hollow construction 38 with the ends of the shaft supported by bearings 64 and 66 for rotatably supporting the blender mixing shaft. The blender shaft includes a plurality of tools 10 disposed thereon as heretofore described.

The resulting advantages include:

1. A high efficiency 100 percent blender; total elimination of "loading" and "resin in-put zones".

2. Minimum resin usage.

3. Blender remains clean and can be operated endlessly on automation.

4. Single port (¼ inch diameter tube) entry is sufficient—eliminating the requirement for multiple resin injection tubes and lines.

5. No exit door required; mixed material simple falls out the end (in continuous blender operation) dust free.

6. There is no dust.

7. Compact and sturdy design makes blender adaptable to fit in for many uses.

8. Mixing tools transport material through the blender; however, movement is by means of a rapid series of small increments; hence there is no mass flow.

9. High ratio of mixer tool surface area rubbing and particle-to-particle rubbing per ton of material per hour. This surface ratio can be calculated.

10. High through-put for a given sized blender.

11. Center of gravity is kept in the center of the shaft—for uniform balance design; hence, it is easily mounted on a platform. (elevated)

12. Adaptable for experiments; retention time can be varied.

13. In this expanded condition the media and particles are free to move and collide and impinge upon one another.

14. There is less tool weight as compared to threaded extended tools with weldments on the shaft; therefore there is more symmetry around the shaft and along the shaft with more natural balance. The invention can allow for no asymmetry.

The present invention provides numerous advantages over the prior art by utilizing a tool which alone or in combination with a blender design and method provide the following features which may be used in blenders for various types of materials. These features include:

1. The invention of a sturdy linear tool, fabricated, welded, or casting material, triangular in cross section, with two flat surfaces in contact with the matrix: hollow and suitable for passage of internal medium (cooling water, hot water, hot oil, steam, or gas) for temperature control; which tool provides action in conveying and mixing simultaneously in a batch blender or continuous blender for a variety of matrices: plastics, wood chips, sand, liquid-liquid, and solid-solid blends.

2. The tool movement, with respect to the matrix, the wedge moving through the particle mass-results in particle-to-particle rubbing in contact with the rapidly moving smooth surfaces, and vector forces created by the wedge movement result in particle movement, particle transfer, random particle impingement on distant particles—creating a plow type action of back and forth movement—but in controlled small increments—in disrupted motion without bulk mass flow.

3. Control of orientation, setting right or left, of the tool invention as heretofore described resulting in: (1) forward direction movement (2) lateral movement or (3) reverse movement with control of through-put, degree of filling, and retention time in the blender cavity.

4. The tool of the invention as heretofore described may be mounted to a shaft by threaded extension, welded connection, or held by bolts (i.e. as in an automobile crankshaft).

5. The tool of the invention may be mounted to a stationary object (i.e. a wall or column inside the blender) when the matrix is pushed past the stationary tool.

6. The tool of the invention may include working surfaces which can be wear coated but preferably provide smooth contact surfaces against the matrix particles for two paramount factors: (1) presenting a high ratio of rubbing surface area per pound (or per ton) of through-put material in a given period of time (per minute or per hour), and (2) direction of the vector force created by the orientation and movement of the tool (i.e. several tools working in unison).

7. Hollow shaft design for a system of internal medium flow whose shaft contains machined flat areas (including a hole through the shaft) for the purpose of mounting the tool of the invention as heretofore described. For three paramount reasons: (1) to make a secure mounting to prevent twisting or movement in relation of the shaft, and (2) to make a secure seal for the liquid in the internal system (i.e. the liquid travels up into the extremities of the mixing tool) (3) to avoid warping the shaft using clamp on vs. weldments.

8. Hollow shaft design as heretofore described with machined flat areas, including a hole in each flat area—located in pairs and opposite each other (180 degrees apart) in order to result in a balance design.

9. Hollow shaft design as heretofore described can be located at selected spacing along the shaft length with adjacent machined areas (each unit consists of opposite pairs) oriented in successive quadrants (i.e. 90 degree orientation as illustrated in FIGS. 12 and 13 between adjacent or successive flat areas)—so that counting a set of four flat areas along the length of the shaft: (1) result in a balanced design and (2) mentally connecting an imaginary line drawn through the mixing arm extensions forms a screw or helix design—the successive mixing tools act in the manner of a transport screw—maximizing the out-put through the blender.—without plugging.

10. The tool invention as heretofore described made from a one part casting (a selected alloy) with flanges (and reinforced gusset design for strength)—for bolted attachment to each around the shaft; the said tool casting having a flat machined area, including a central hole, for selected fitting on the shaft to: (1) fit securely on the shaft without slippage, and (2) complete a liquid seal with the internal medium (i.e. water cooling).

11. The tool invention as heretofore described may be located in pairs on opposite sides of the shaft so that the flanges can be bolted together (i.e. in a wrap around construction) to form: (1) balanced construction, and (2) a tight seal for the internal medium.

12. The invention of a batch blender or continuous blender of balanced and compact design (i.e. narrow space between support bearings) with 100 percent transport, temperature control, and thoroughly random mixing by design with the invented tool as heretofore described and constructed in the manner as heretofore described.

13. The invention of a batch blender or continuous blender of well balanced and compact design capable of extreme high energy in-put (1000 RPM to 3000 RPM or higher) when designed according to the invention.

14. The invention of a batch blender or continuous blender of well balanced and compact design with versatile characteristics of blending in regard to: (1) Variation of through-put—by setting of tool orientation as heretofore described (2) Degree of filling as controlled by a series of tools set so as to reverse materials as desired and made possible by the method of the present invention.

15. The invention of a batch blender or a continuous blender of well balanced and compact design that is adaptable for the separate function of resin in-put in particleboard plants and using the existing particleboard blender (i.e. a larger blender at lower RPM) used as a secondary blender.—a blender design adaptable to may industries and many multi-stage blending procedures.

16. The blender capable of use as a vacuum dryer used with controlled heating, air flow and bearing seals.

17. Design of the hollow shaft flat-to-flat as heretofore described and illustrated in FIGS. 7 and 11 keeps the center of gravity in the center of the shaft resulting in balanced construction and easier mounting and adaptability.

18. Design of a high energy blender that eliminates the need for resin in-put tubes and such type systems that are expensive to install and more costly to maintain.

It is of course to be understood that the present invention is by no means limited to the specific figures shown in the drawings, but also comprises any modification within the scope of the appended claims.

What is claimed is:

1. In combination, an elongated blender mixing shaft and at least one high speed mixing and transport tool secured thereto, comprising:

said elongated blender mixing shaft having an essentially circular sidewall, a hollow interior, and at least one flat area formed on the exterior surface of said sidewall;

a transverse opening extending through said sidewall and said at least one flat area;

a linear elongated mixing tool having a substantially uniform cross sectional area and provided with a substantially hollow interior for the circulation of a fluid medium therein;

said linear elongated mixing tool having a mixing shaft attachment end and a plow shaped terminating end;

said linear elongated mixing tool further including a substantially triangular shaped section of a substantially uniform triangular cross section disposed between said mixing shaft attachment end and said plow shaped terminating end;

said substantially triangular shaped section having a center axis and an apex formed by the intersection of two sides extending from a base side forming said substantially triangular shaped section;

said center axis of said substantially triangular shaped section being substantially in the center of said mixing shaft attachment end to align said mixing and transport tool essentially perpendicular to the center axis of said elongated mixing shaft; and means for alignment of said base relative to said center axis of said mixing shaft and providing a fluid tight seal between said mixing shaft and said interior of said linear elongated mixing and transport tool.

2. The combination of claim 1 wherein said substantially triangular shaped section of a substantially uniform triangular cross section is selected from the group of triangular configurations consisting of a generally isosceles triangular configuration, a generally scalene triangular configuration, a generally acute triangular configuration, and a generally right triangular configuration.

3. The combination of claim 1 wherein said elongated blender shaft has at least two flat areas formed on the exterior surface thereof;

said at least two flat areas being disposed in opposed locations on said shaft;

a U-shaped casting having integral end flanges thereon being disposed on each of said at least two flat areas;

said mixing shaft attachment end being integral with each of said U-shaped castings;

said flanges on one of said U-shaped casting being bolted to the flanges on another U-shaped casting to thereby effect alignment of said mixing shaft attachment ends essentially perpendicular to the center axis of said elongated mixing shaft;

said U-shaped castings also serving as said means for the alignment of said base relative to said center axis of said mixing shaft and to provide the fluid tight seal between said mixing shaft and said interior of said linear elongated mixing and transport tool.

4. A high speed transport and mixing tool comprising, in combination:

an elongated blender mixing shaft and at least one linear elongated transport and mixing tool secured to said elongated blender mixing shaft;

said mixing shaft having an essentially circular sidewall, a hollow interior, and at least one flat area formed on the exterior surface of said sidewall;

a transverse opening extending through said sidewall and said at least one flat area;

said at least one elongated transport and mixing tool having a substantially uniform cross sectional area and having a substantially hollow interior for the circulation of a fluid medium for controlling temperature thereof;

said linear elongated mixing tool having a mixing shaft attachment end, a plow shaped terminating end and a substantially triangular shaped section of a substantially uniform triangular cross section disposed between said mixing shaft attachment end and said plow shaped terminating end;

said substantially triangular shaped section having a center axis and an apex formed by the intersection of two sides integrally extending from a base and forming said substantially triangular shaped section;

said center axis of said substantially triangular shaped section being substantially in the center of said substantially triangular shaped section and aligned essentially perpendicular to the center axis of said mixing shaft; and means providing alignment of said base relative to a plane parallel with said center axis of said mixing shaft.

5. The combination claim 4 wherein said mixing shaft attachment end is integral with a U-shaped casting having end flanges, said casting being secured via said flanges to said mixing shaft and serving to fix and provide the orientation of said base of said substantially triangular shaped section along a plane orientated to the right of a plane taken parallel with said center axis of said mixing shaft.

6. The combination of claim 4 wherein said mixing shaft attachment end is integral with a U-shaped casting having end flanges, said casting being secured via said flanges to said said mixing shaft and serving to fix and provide the orientation of said base of said substantially triangular shaped section along a plane orientated to the left of a plane taken parallel with said center axis of said mixing shaft.

7. The combination of claim 6 wherein said U-shaped casting fixes the orientation of said base of said substantially triangular shaped section approximately 40 degrees to the left of a plane taken parallel with said center axis of said mixing shaft.

8. The combination of claim 4 wherein said substantially triangular shaped section of a substantially uniform triangular cross section is selected from the group of triangular configurations consisting of a generally scalene triangular configuration; a generally acute triangular configuration; a generally right triangular configuration; and, a generally isosceles triangular configuration.

9. The combination high speed transport and mixing tool of claim 4 wherein said at least one flat area formed on the exterior surface of said sidewall includes at least a pair of flat areas disposed in diametric relationship on said sidewall; and said at least one elongated transport and mixing tool includes at least two elongated transport and mixing tools; each of said at least two elongated transport and mixing tools including a mixing shaft attachment end integral with a U-shaped casting having end flanges, each said casting being disposed in wrap around fashion about said mixing shaft at said flat areas; said U-shaped castings being secured to each other via bolts extending through said end flanges thereon to form a fluid tight seal between said mixing shaft and said at least two elongated transport and mixing tools; said castings fixing the orientation of said base of said substantially triangular shaped section relative to a plane taken parallel with the center axis of said mixing shaft.

10. The combination of claim 9 wherein the orientation of said base of said substantially triangular shaped section relative to a plane taken parallel with the center axis of said mixing shaft is selected from the group of orientation planes consisting of (a) a plane parallel with the center axis of said mixing shaft axis; (b) a plane oriented to the right relative to said plane taken parallel to the center axis of said mixing shaft; and (c) a plane oriented about 40 degrees to the left relative to said plane taken parallel with the center axis of said mixing shaft.

* * * * *